US006263817B1

(12) United States Patent
Tajima et al.

(10) Patent No.: US 6,263,817 B1
(45) Date of Patent: Jul. 24, 2001

(54) EMBROIDERY AUXILIARY MEMBER, AND EMBROIDERY METHOD AND EMBROIDERY PRODUCT USING THE MEMBER

(75) Inventors: Ikuo Tajima, Kasugai; Shunzo Nanba, Nagoya, both of (JP)

(73) Assignee: Tokai Kogyo Mishin Kabushiki Kaisha, Kasugai (JP)

( * ) Notice: Subject to any disclaimer, the term of this patent is extended or adjusted under 35 U.S.C. 154(b) by 0 days.

(21) Appl. No.: 09/445,468

(22) PCT Filed: Jun. 22, 1998

(86) PCT No.: PCT/JP98/02792

§ 371 Date: Dec. 22, 1999

§ 102(e) Date: Dec. 22, 1999

(87) PCT Pub. No.: WO98/59101

PCT Pub. Date: Dec. 30, 1998

(30) Foreign Application Priority Data

Jun. 23, 1997 (JP) ..... 9-165953

(51) Int. Cl.[7] ..... D05C 17/00; B32B 7/08

(52) U.S. Cl. ..... 112/475.22; 112/439

(58) Field of Search ..... 112/475.22, 439; 2/244; 156/90

(56) References Cited

U.S. PATENT DOCUMENTS 2,365,315 * 12/1944 Williams ..... 112/439 X
4,103,634 * 8/1978 Schachter ..... 112/439
5,241,919 * 9/1993 Lagreca ..... 112/439 X

FOREIGN PATENT DOCUMENTS 40-35503 12/1965 (JP) .
5186957 7/1993 (JP) .
5195411 8/1993 (JP) .

* cited by examiner

*Primary Examiner*—Ismael Izaguirre
(74) *Attorney, Agent, or Firm*—Dennison, Scheiner, Schultz & Wakeman

(57) ABSTRACT

The present invention provides an embroidery auxiliary member that is superimposed on a base fabric, embroidered together with the base fabric by embroidery yarn, and thereafter removed. The embroidery auxiliary member is made of a tetrachloroethylene soluble material and includes a spacer and a support sheet. The spacer is utilized for forming a hollow three-dimensional embroidery pattern using embroidery yarn and has a predetermined thickness. The support sheet is utilized for supporting the base fabric during an embroidering operation. A method of embroidering by using the spacer comprises the steps of placing the spacer on the base fabric, sewing the base fabric through the spacer using the embroidering yarn, and dissolving the spacer with tetrachloroethylene. A method of embroidering by using the support sheet comprises the steps of holding the support sheet in a flat state, placing the base fabric on the support sheet, sewing the base fabric together with the support sheet using the embroidering yarn, and dissolving the support sheet with tetrachloroethylene. In the embroidering method using the spacer, a three-dimensional embroidery product having a unique appearance can be obtained by sewing the embroidery yarn in a net-like form.

35 Claims, 10 Drawing Sheets

EMBROIDERY AUXILIARY MEMBER, AND EMBROIDERY METHOD AND EMBROIDERY PRODUCT USING THE MEMBER

FIELD OF THE INVENTION

The present invention relates to embroidery auxiliary members that are adapted to be superimposed on a base fabric, sewn together with the base fabric using embroidery yarn, and thereafter removed. The present invention also relates to embroidery methods and embroidery products using the embroidery auxiliary members.

RELATED ART

Embroidery auxiliary members have been adapted to be superimposed on a base fabric, sewn together with the base fabric by embroidery yarn, and thereafter removed. Such embroidery auxiliary members have been used for the following two known applications:

(1) "Spacer" for forming hollow three-dimensional embroideries.

(2) "Support member" for supporting a base fabric during an embroidering operation.

The technique relating to the (1) "spacer" application will now be explained. A method of manufacturing hollow three-dimensional embroidery products using a known embroidery machine is disclosed in Japanese Laid-Open Patent Publication No. 5-195411. The principle of the manufacturing method disclosed in this publication is based on the steps of: laying a sheet-like member on a base fabric, which sheet-like member has a predetermined thickness and is also known as a "spacer" that is soluble for removal; and embroidering by sewing over the spacer. After completion of the embroidering operation, the spacer existing between embroider yarn, which have been sewn over the base fabric, and the upper surface of the base fabric is dissolved and removed. As a result, the embroidery yarn remains in a three-dimensional form, so that a hollow three-dimensional embroidery product can be obtained. In order to remove the spacer, three different methods have been utilized in the art, which methods include (A) dissolving in water, (B) melting by heat, and (C) dissolving in an organic solvent.

According to method (A), a plate made of water-soluble material, such as a starch wafer, or a non-woven fabric formed of polyvinyl alcohol fibers (PVA felt), is used as a spacer and is dissolved in a room temperature water or hot water. However, with this method, the dissolved spacer material has a paste-like consistency, so that it is difficult to completely remove the dissolved material from the embroidery product. According to method (B), as disclosed in Japanese Patent Publication Nos. 59-7824 and 60-42311, this method must be carried out with the aid of an absorbable material that is applied to the spacer material while it melts, in order to prevent the embroidery yarn from absorbing the melted spacer material. Therefore, the removal of the melted spacer material is quite difficult.

In contrast, in the case of method (C), acetate fabric, diacetate felt (non-woven fabric), an expanded polystyrene plate or the like are used as spacers and are adapted to be dissolved in an organic solvent, such as acetone or 1-2 dichloroethane. If acetone or 1-2 dichloroethane is used, the removal operation of the dissolved spacer can be performed more easily than the above methods (A) and (B).

However, acetone and 1-2 dichloroethane are highly flammable, such that the handling of these solvents is dangerous. If these solvents are used, the spacer dissolving and removing operation should be performed in an explosion-proof installation. Therefore, this spacer dissolving and removing method that uses such organic solvents can be practiced only by manufacturers who can install a large-scale explosion-proof plant. An ordinary manufacturer of embroidery products cannot practice this method.

The technique relating to the (2) "Support member" application for supporting a base fabric during an embroidering operation will now be explained. For example, Japanese Laid-Open Patent Publication No. 5-186957 teaches the use of a synthetic resin sheet made of synthetic resin as a support member, which synthetic resin sheet is soluble in solvents that are used for a dry-cleaning purposes. The solvents listed in this publication as being appropriate for dry-cleaning purposes include trichloroethane, trichloroethylene, tetrachloroethylene and petroleum solvents (mineral spirit or mineral turpentine). The synthetic resins listed in this publication as being soluble in these solvents include ethylene, vinyl acetate copolymer, polyvinyl acetate, polyethylene and polypropylene or mixtures thereof.

However, in order to practice the technique disclosed in this publication, it is necessary to heat the solvents. In fact, in the preferred embodiments disclosed in the publication, the solvents are heated to 60°–90° depending on their properties.

Thus, in order to practice the technique of this publication, heating means as well as temperature control means for maintaining the temperature of the solvents at suitable temperatures is required. In addition, in order to prevent the evaporated solvents from exploding, a pressure-resistant and explosion-proof installation is required. Therefore, the embroidering method using the support members of this publication is expensive.

Further, among the solvents listed in the publication, the production of trichloroethane and trichloroethylene has already been discontinued in Japan, because of their harmful effect on the environment or the human body. This is also a worldwide trend. Further, because petroleum solvents are flammable, an explosion-proof installation is required as discussed in connection with (1).

Although tetrachloroethylene is available, support members that are made from materials listed above may not, in practice, be dissolved in this solvent, even if the solvent has been heated.

Therefore, the actual technique that can be practiced involves dissolving and removing the support member using petroleum solvents and based on the conditions that an explosion-proof installation and heating means are incorporated in the technique.

As described above, for any of the embroidery auxiliary members as discussed in (1) and (2), a problem exists that an expensive installation is required.

SUMMARY OF THE INVENTION

One aspect of the present invention provides an embroidery auxiliary member that can be easily dissolved and removed without increasing costs.

Another aspect of the present invention provides an embroidery auxiliary member and a method of manufacturing an embroidery product by using such an embroidery auxiliary member that can be used as a spacer for forming a three-dimensional embroidery and that can be easily dissolved and removed.

Another aspect of the present invention provides an embroidery auxiliary member and a method of manufacturing an embroidery product by using such an embroidery auxiliary member that can be used as a support member for supporting a base fabric during an embroidering operation and that can be easily dissolved and removed.

Another aspect of the present invention provides a method of easily manufacturing a hollow three-dimensional embroidery product by using an embroidery auxiliary member that is utilized as a spacer for forming the hollow three-dimensional embroidery pattern, and another embroidery auxiliary member that is utilized as a support member for supporting a base fabric during an embroidering operation.

Another aspect of the present invention provides a hollow three-dimensional embroidery product that has an unique appearance.

According to the invention an embroidery auxiliary member is provided, which embroidery auxiliary member is adapted to be superimposed on a base fabric, embroidered together with the base fabric using embroidery yarn, and thereafter removed, the embroidery auxiliary member being made of material that is soluble in tetrachloroethylene.

Here, "tetrachloroethylene" is a solvent that is also known as perchloroethylene or perchlene, and broadly known according to its Japanese name of "shienka-echiren."

Tetrachloroethylene is a non-combustible compound and is not easily flammable. Therefore, the dissolving and removing operation may not have a danger of explosion. For this reason, an explosion-proof installation is not needed to dissolve and remove the embroidery auxiliary member.

In addition, because the embroidery auxiliary member can be immediately dissolved in tetrachloroethylene, which is an organic solvent, at any temperature including ordinary temperatures (atmospheric temperature), a heating means is not needed for the solvent. Therefore, the cost for the removal operation can be reduced.

According to a further aspect, the invention relates to a construction, in which the auxiliary embroidery member includes a spacer that is used for forming a hollow three-dimensional embroidery using embroidery yarn and that has a predetermined thickness.

Because the spacer is removed after it has been sewn together with the base fabric using embroidery yarn, a space corresponding to the thickness of the spacer is produced between the upper surface of the base fabric and the embroidery yarn stitched over the spacer. Therefore, the embroidery yarn is left in a three-dimensional form, so that a hollow three-dimensional product can be obtained. The advantage of claim 2 is the same as claim 1.

According to a further aspect, the invention relates to a construction, in which the spacer is made of expanded polystyrene. By using expanded polystyrene, the space may have a great height without causing an increase in weight or reduction in dissolving speed.

According to a further aspect, the invention relates to a construction, in which the spacer includes a protective membrane formed on a surface of the spacer opposite to the base fabric. With the provision of the protective membrane, the embroidery yarn may not cut the surface portion of the space or the embroidery yarn may not enter the spacer. Therefore, all the stitches sewn over the spacer may have a uniform length and height, so that spaces within the stitches formed after dissolving the spacer may have a uniform height. As a result, a hollow three-dimensional product that has an appealing appearance can be obtained.

According to further aspect, the invention relates to a construction, in which the protective membrane is made of material that is soluble in tetrachloroethylene. With this construction, the protective membrane can be dissolved and removed simultaneously with the spacer by the same step. Therefore, a hollow three-dimensional embroidery product that has the features described in connection with claim 4 can be easily manufactured.

According to a further aspect, the invention relates to a construction, in which the protective membrane is resilient. Therefore, the embroidery yarn can penetrate the protective membrane to some extent even when a great force tensions the embroidery yarn. As a result, the embroidery yarn can be prevented beforehand from being cut.

According to a further aspect, the invention relates to materials for the protective membrane. The protective membrane may be made of a polymeric compound selected from a group consisting of polyacrylate, polymethacrylate, polyisoprene and polybutadiene, or may be made of a co-polymeric compound including at least two monomers selected from a group consisting of acrylate, methacrylate, isoprene and butadiene. With the selection of these materials, a protective membrane can be formed having suitable resiliency and being soluble in tetrachloroethylene.

According to a further aspect, the invention relate to details of the protective membrane. The protective membrane is formed by evaporating a volatile solvent from a solution that has been prepared by dissolving a tetrachloroethylene soluble material in the volatile solvent. The protective membrane may be formed by attaching a tetrachloroethylene soluble sheet-like material to the spacer.

In particular, a protective membrane that has a uniform thickness can be easily and reliably formed on the surface of the spacer by forming the protective membrane through the evaporation of a volatile solvent from a solution that has been prepared by dissolving a tetrachloroethylene soluble material in the volatile solvent, and especially through the evaporation of the volatile solvent after applying the solution to the spacer by means of a spray As a result, the problem, in which the embroidery yarn will cut the surface of the spacer and penetrate the spacer during the embroidering operation, can be further reliably prevented.

According to a further aspect, the invention relates to a construction, in which the embroidery auxiliary member comprises a support sheet for supporting the base fabric during the embroidering operation. The support sheet is utilized if the base fabric is a thin fabric or a knit and cannot be embroidered unless a support member supports it. The support sheet is sewn together with the base fabric and is thereafter removed. As a result, an embroidery product that consists only of the base fabric and the embroidery yarn can be obtained. For this purpose, it is preferable that the support sheet has a thickness as small as possible.

According to a further aspect, the invention relates to materials of the support sheet. Thus, the support sheet may be formed of a mixed film with polystyrene and polybutadiene or with polystyrene and an oxidizing agent, such as metallic oxide, so that the support sheet may be resilient and tough, even if it has a thin thickness.

According to a further aspect, the invention relate to the construction of preferred embodiments, in which the support sheet is used for a placing-on sewing operation. The support sheet may be adapted to freely support the base fabric on its upper surface, or an embroidery frame at its peripheral portion may hold the support sheet.

According to a further aspect, the invention relates to the construction, in which the support sheet is formed with irregularities, at least in an area where the base fabric is placed. With the formation of the irregularities, the displacement of the base fabric can be prevented, so that the embroidery can be reliably formed at a predetermined position.

According to a further aspect, the invention relates to the details of a means for forming the irregularities. Thus, embossing the support sheet can easily form the irregularities.

According to a further aspect, the invention relates to a method of manufacturing a three-dimensional embroidery product by using the spacer, the method comprising the steps of:

a) placing the spacer on the base fabric;

b) sewing the base fabric through the spacer using embroidering yarn; and c) dissolving the spacer with tetrachloroethylene.

According to a further aspect, the invention relates to a method that further includes, prior to the step a) the step of:

d) forming a tetrachloroethylene soluble protective membrane on the spacer side opposite to the base fabric.

According to a further aspect, the invention relaters to the details of the step of forming the protective membrane. Thus, in step d), the protective membrane can be easily formed by evaporating a volatile solvent from a solution that has been prepared by dissolving a tetrachloroethylene soluble material in the volatile solvent.

According to a further aspect, the invention relates to a method, in which the base fabric is previously embroidered or printed to include a desired pattern, the embroidery yarn is sewn over the desired pattern through the spacer in step b), so that at least a part of the pattern is visible through the three-dimensional embroidery of the three-dimensional embroidery product formed by step c).

With this method, because the pattern that has been previously embroidered or printed on the base fabric of the embroidery product can be viewed through the three-dimensional embroidery pattern, a unique appearance can be given to the embroidery product.

According to a further aspect, the invention relate to details of the method of forming the three-dimensional embroidery pattern. Thus, the embroidery yarn may be sewn in a net-like form in step b), or the embroidery yarn maybe semitransparent. With these methods, the pattern on the base fabric can be viewed through the net-like pattern or through the embroidery yarn themselves.

According to a further aspect, the invention relates to a method of manufacturing an embroidery product by using the support sheet and comprises the steps of:

a) holding the support sheet in a flat state;

b) placing the base fabric on the support sheet;

c) sewing the base fabric together with the support sheet using embroidering yarn; and d) dissolving the support sheet with tetrachloroethylene.

According to a further aspect, the invention relates to the construction of preferred embodiments, in which the support sheet is used for a placing-on sewing operation. Thus, step a) comprises the step of holding the support sheet at its peripheral portion using an embroidery frame.

According to a further aspect, the invention relates to a construction, in which the support sheet is formed with irregularities, at least in an area where the base fabric is placed.

According to a further aspect, the invention relates to a method of manufacturing a three-dimensional embroidery product using the spacer and using the support sheet, comprising the steps of:

a) holding the support sheet in a flat state;

b) placing the base fabric on the support sheet;

c) placing the spacer on the base fabric;

d) sewing the base fabric together with the support sheet and the spacer using embroidery yarn; and e) dissolving the support sheet and the spacer with tetrachloroethylene.

According to this method, although the support sheet and the spacer are embroidery auxiliary members that are adapted to be superimposed on the base fabric, sewn together with the base fabric using the embroidery yarn, and thereafter removed, they have different functions from each other and can be dissolved and removed by the same step to manufacture a three-dimensional embroidery product. Therefore, this method is advantageous in that the manufacturing process is simplified.

According to a further aspect, the invention relates to the method in which the support sheet is used for a placing-on sewing operation, and in which step a) comprises the step of holding the support sheet at its peripheral portion using an embroidery frame.

According to a further aspect, the invention relates to a construction, in which the support sheet is formed with irregularities, at least in an area where the base fabric is placed.

According to a further aspect, the invention relates to the method, in which the spacer includes a protective membrane formed on its upper surface, step d) includes the step of also sewing together with the protective membrane, step d) includes the step of also dissolving the protective membrane with tetrachloroethylene. With the provision of the protective membrane, the same advantages as described previously can be obtained. In addition, because the protective membrane can also be dissolved in the same step together with the support sheet and the spacer, the manufacturing process can be further simplified.

According to a further aspect, the invention relates to a three-dimensional embroidery product that is manufactured by the method and comprises the base fabric, the pattern embroidered or printed on the base fabric, and the three-dimensional embroidery portion embroidered to be superimposed on the pattern, so that at least a portion of the pattern can be viewed through the three-dimensional embroidery portion.

According to a further aspect, the invention relate to embodiments of the three-dimensional embroidery portion. Sewing the embroidery yarn in a net-like form may form the three-dimensional embroidery portion or the embroidery yarn may be made of semitransparent material.

Additional features, aspects and advantages of the invention will become more fully apparent from the claims and the description when it is read in connection with the drawings.

DETAILED DESCRIPTION OF THE PREFERRED EMBODIMENTS

Preferred embodiments of the present invention will now be described with reference to the drawings.

First, a first embodiment of the present invention will now be explained with reference to FIGS. 1 to 6. This embodiment relates to an embroidery auxiliary member that is used as a spacer (1) for forming a three-dimensional embroidery previously discussed in the description of Related Art.

Figure 1:
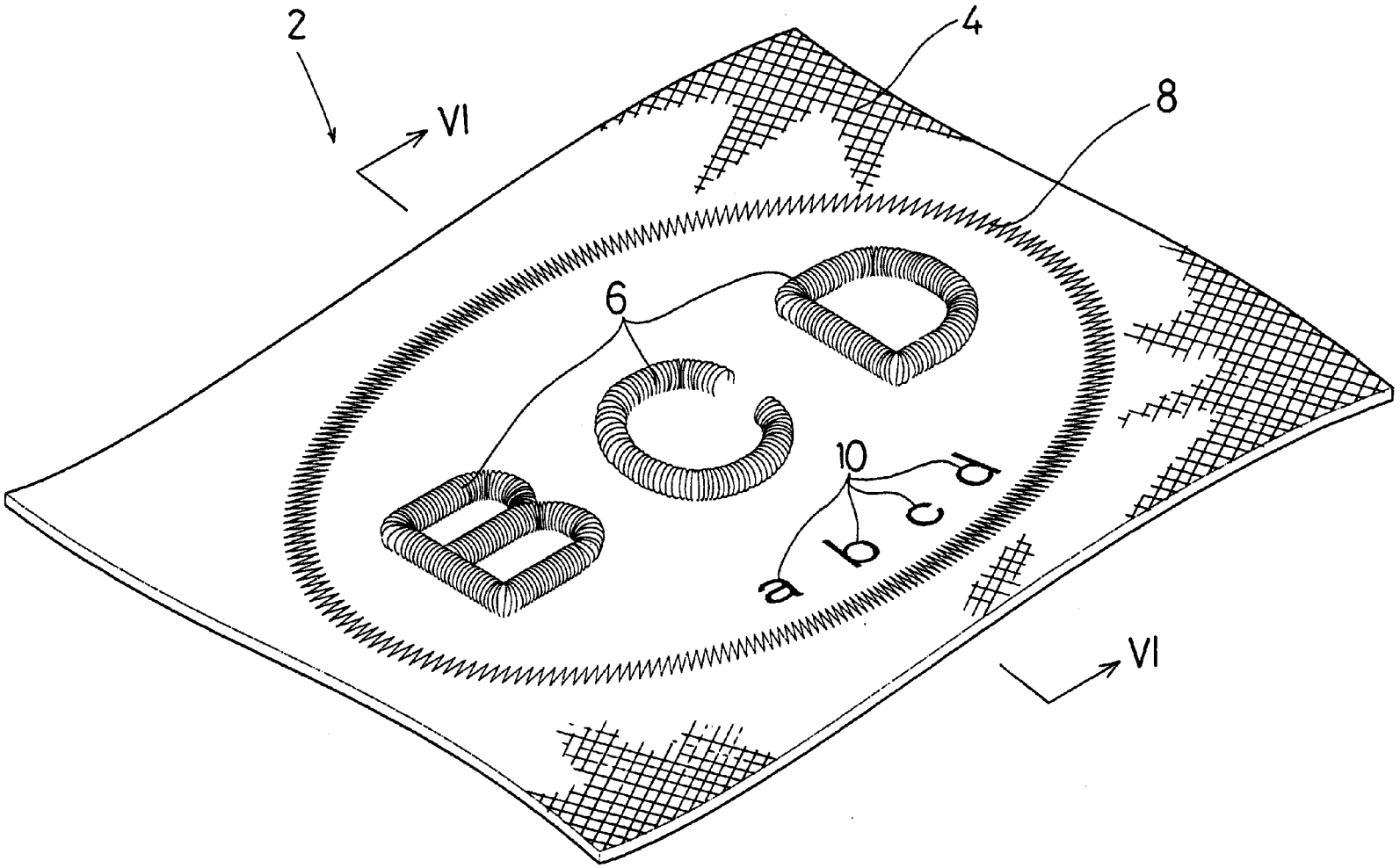
FIG. 1 is a perspective view of an embroidery product that has been manufactured by using an embroidery auxiliary member according to a first embodiment of the present invention.

As shown in FIG. 1, a hollow three-dimensional embroidery product 2 comprises hollow three dimensional embroideries and flat or unraised embroideries stitched into a base fabric 4 that is made of felt, which is insoluble in tetrachloroethylene. Capital letter embroidery portions 6 are embroidered in the central area of the base fabric 4 and are represented by the capital letters "B", "C" and "D", respectively. A peripheral embroidery portion 8 is embroidered to surround the capital letter embroidery portions 6 in an elliptical form. Lower case letter embroidery portions 10 are stitched into the base fabric 4 along the inside edge of the peripheral embroidery portion 8 and are represented by the lowercase letters "a", "b", "c" and "d", respectively.

The capital letter embroidery portions 6 are the hollow three-dimensional embroideries, while the peripheral embroidery portion 8 and the lowercase letter embroidery portions 10 are the flat or unraised embroideries.

The steps that may be performed in manufacturing the hollow three-dimensional embroidery product 2 will now be described with reference to FIGS. 2 to 6.

Figure 2:
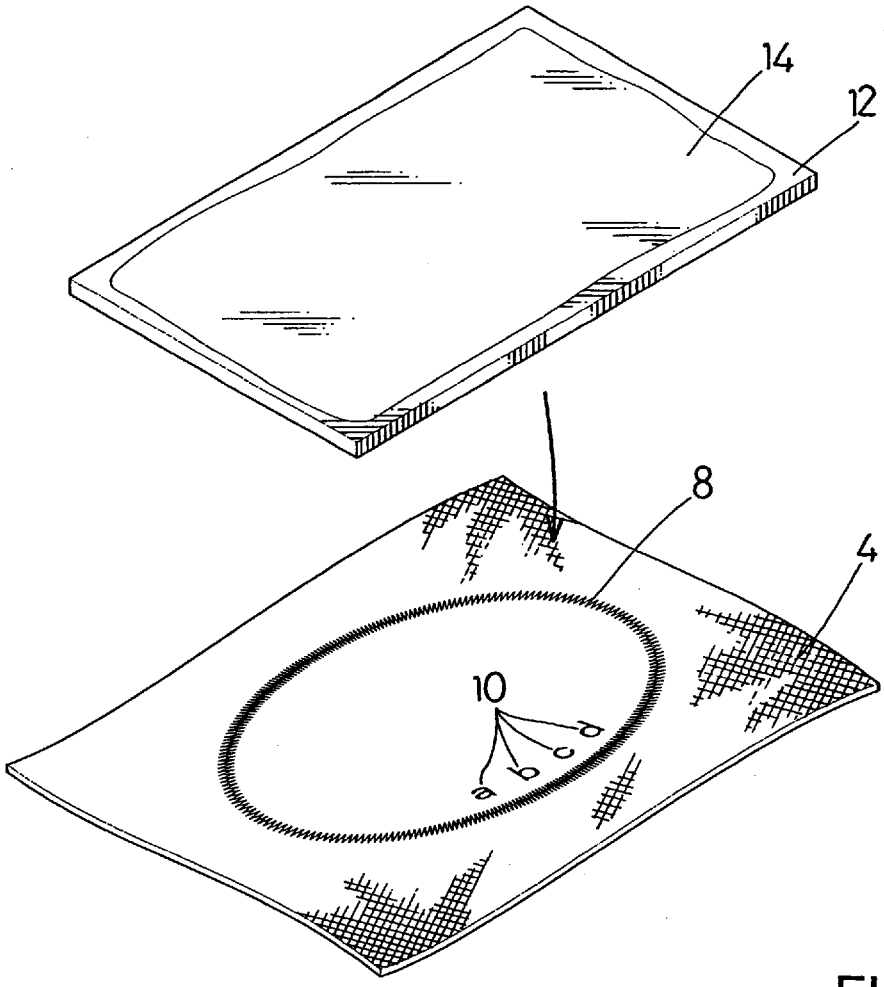
FIG. 2 is a perspective view showing one of the steps of manufacturing the embroidery product shown in FIG. 1.

First, as shown in the bottom embodiment of FIG. 2, the peripheral embroidery portion 8 and the lowercase letter embroidery portions 10 (embroideries in forms of the lowercase letters "a", "b", "c" and "d") are sewn using embroidery yarn in a flat embroidering manner. The embroidery yarn is made of a material that is insoluble in tetrachloroethylene.

Figure 3:
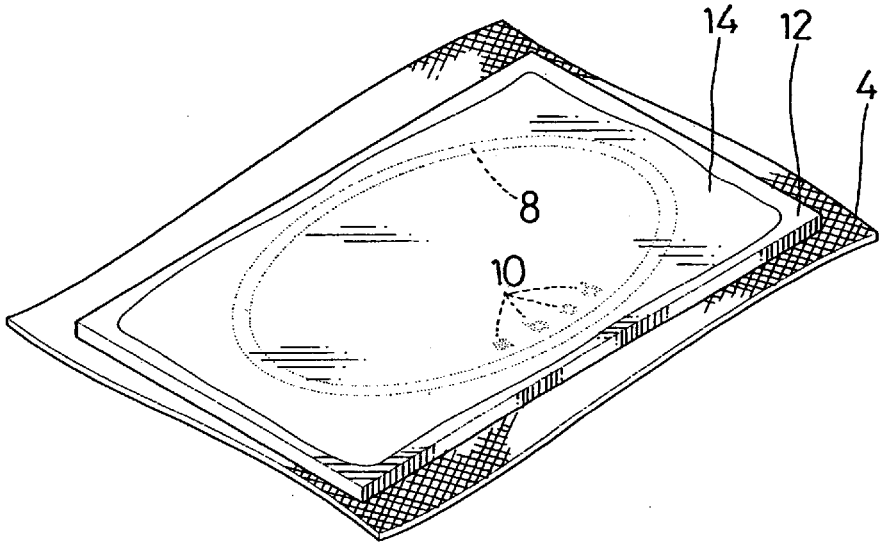
FIG. 3 is a perspective view showing the state after the step of FIG. 2 has been performed.

Then, as shown in FIG. 2, a plate-like spacer 12 having a predetermined thickness is placed on the top surface of the base fabric 4 that has been embroidered with a flat embroidering manner as described above. The spacer 12 is made of expanded polystyrene that is immediately soluble in tetrachloroethylene at ordinary temperatures (atmospheric temperature). As a result, in this state, the peripheral embroidery portion 8 and the lowercase letter embroidery portions 10 are masked below the spacer 12 as shown in FIG. 3.

A protective membrane 14 may be previously formed on the upper surface of the spacer 12. In this embodiment, the protective membrane 14 is made of an acrylic acid-methyl acrylate-butadiene copolymer, which is also immediately soluble in tetrachloroethylene at ordinary temperatures (atmospheric temperature). The acrylic acid-methyl acrylate-butadiene copolymer is dissolved in a volatile organic solvent to form a liquid solution of the copolymer. The liquid solution is then poured into a spray can and is sprayed directly onto the upper surface of the spacer 12. After the organic solvent evaporates, the protective membrane 14 remains as a deposit on the upper surface of the spacer 12.

Although the spraying step of the liquid solution is performed in this embodiment prior to placing the spacer 12 on the felt 4, this spraying step also may be performed after the spacer 12 has been placed on the felt 4.

The expanded polystyrene that is used in this embodiment as the material for the spacer 12 is distributed under the brand name "styrene board" available from Sekisui Chemical Products Industry Co., Ltd. in Tokyo, Japan.

The percentage of each of the monomer components (acrylic acid, methyl acrylate and butadiene monomers) in the copolymer may be chosen such that the membrane 14 formed after evaporation of the organic solvent has appropriate resiliency. If the resiliency is too weak (or if the membrane 14 has become too hard), a possibility exists that the membrane 14 will be cut by the embroidery yarn during the embroidering operation and that the membrane 14 may not perform its proper function. On the other hand, if the resiliency is too strong (or if the membrane 14 is too soft), the sewing needle may get tangled in the membrane 14 during the embroidery operation. Therefore, the embroidering operation may not be properly performed.

Subsequently, the capital letter embroidery portions 6 are embroidered on the base fabric 4 over the spacer 12 which has been superimposed on the base fabric 4 as shown in FIG. 3. The capital letter embroidery portions 6 are represented by the capital letters "A", "B", "C" and "D", respectively, as shown in FIG. 4 and are sewn using embroidery yarn that is made of a material that is insoluble in tetrachloroethylene.

Figure 4:
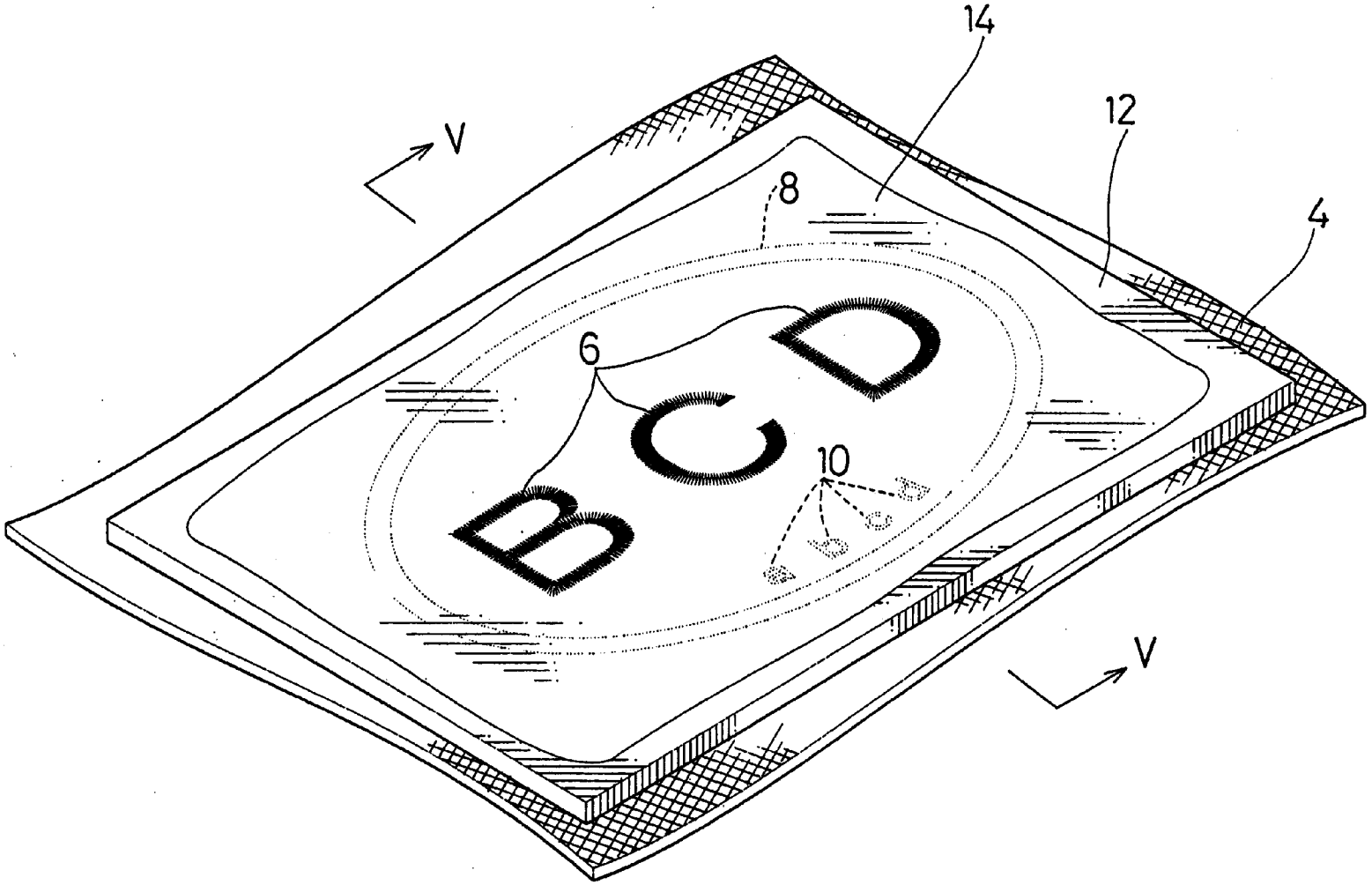
FIG. 4 is a perspective view showing the step following to the step of FIG. 3.
Figure 5:
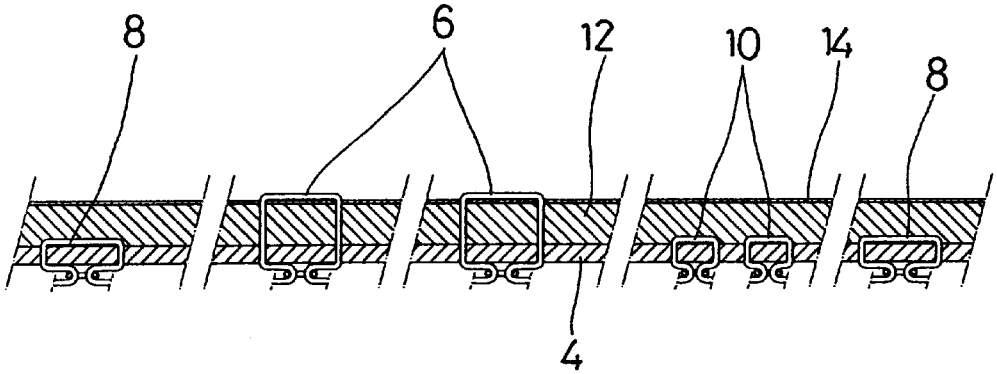
FIG. 5 is a sectional view taken along line V—V in FIG. 4.

According to the above steps, the embroidery stitches are formed in the capital letter embroidery portions 6 over the spacer 12 and the protective membrane 14 as shown in FIG. 5, which is a sectional view taken along line V—V in FIG. 4. By providing the protective membrane 14 on the spacer 12 which has appropriate resiliency, the embroidery yarn may be reliably prevented from cutting and penetrating the spacer 12 during the embroidering operation of the capital letter embroidery portions 6. As a result, all the stitches formed over the spacer 12 have a uniform length and height, as shown in FIG. 5.

The embroidered object prepared in the manner described above is immersed into a container filled with a tetrachloroethylene solution. By agitating the tetrachloroethylene solution, the spacer 12 and the protective membrane 14 may be completely dissolved in the tetrachloroethylene solution. Thereafter, the embroidered object is removed from the tetrachloroethylene solution and is allowed to dry. Thus, the spacer 12 and the protective membrane 14 are removed after the embroidering operation and serve as embroidery auxiliary members. The tetrachloroethylene solution, in which the spacer 12 and the protective membrane 14 have been dissolved, may be recovered through distillation and can be used again for the dissolving operation.

Figure 6:
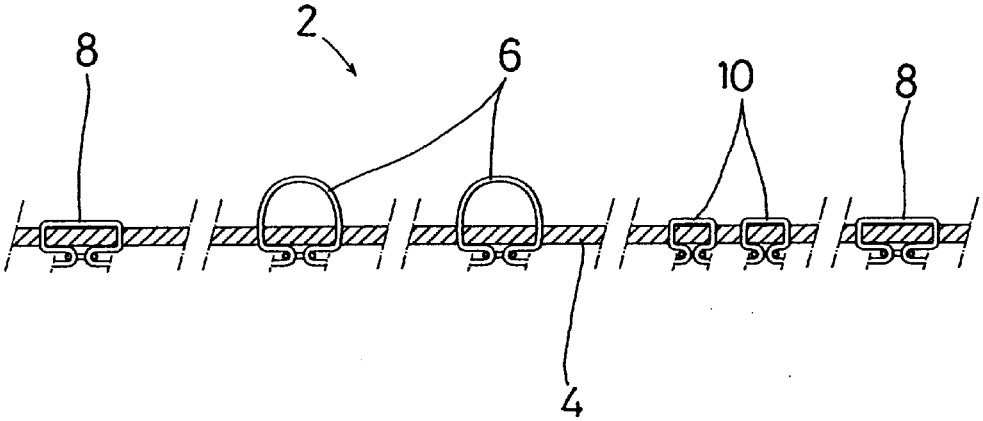
FIG. 6 is a sectional view taken along line VI—VI in FIG. 1.

The hollow three-dimensional embroidery product 2 shown in FIG. 1 may be completed according the above manufacturing process. As shown in FIG. 6, which is a sectional view taken along line VI—VI in FIG. 1, the stitches in the capital letter embroidery portions 6 extend upwardly, so that each stitch has a hollow three-dimensional configuration.

Because all of the stitches sewn over the spacer 12 have a uniform length and height prior to the removal of the spacer 12 and the protective membrane 14, hollow portions of the stitches at the capital letter embroidery portions 6 have a uniform height as shown in FIG. 6, so that a hollow three-dimensional product having an appealing appearance can be obtained.

The height (degree of blistering) of the capital letter embroidery portions 6 can be varied by suitably selecting the thickness of the spacer 12.

With the above manufacturing process, the dissolving and removing process can be performed without danger of explosion, because tetrachloroethylene is a noncombustible compound and is not easily flammable. Therefore, an explosion-proof installation is not required for the dissolving and removing process of the spacer 12 using tetrachloroethylene. In addition, because the spacer 12 is made of expanded polystyrene that is immediately soluble in an organic solvent or tetrachloroethylene at ordinary temperatures (atmospheric temperature), the spacer 12 can be easily dissolved and removed.

Further, tetrachloroethylene is a material that is commonly used as a dry-cleaning agent in laundries. Therefore, the dissolving and removing process using tetrachloroethylene can be replaced by requesting a laundry to dry-clean the embroidered product.

Therefore, any embroiders or ordinary persons, who do not have installations for dissolving and removing, could easily manufacture a hollow three-dimensional embroidery product.

In the preferred embodiments, expanded polystyrene and acrylic acid-methyl acrylate-butadiene copolymer are used as the materials for the spacer 12 and the protective membrane 14, respectively. However, any other suitable materials can be used in place of these materials.

For example, any materials, in addition to acrylic acid-methyl acrylate-butadiene copolymer, can be used in the protective membrane, as long as these materials are soluble in tetrachloroethylene at ordinary temperatures (atmospheric temperature) and have resiliency. Such materials may include polymeric compounds, such as polyacrylate (including acrylic acid-methyl acrylate copolymer), polymethacrylate (including methacrylic acid-methyl methacrylate copolymer), polyisoprene, polybutadiene, and copolymeric compounds comprising two, three or four of these kinds of monomers.

In this embodiment, in order to form the protective membrane 14, a liquid comprising a protective membrane material dissolved in a volatile organic solvent is poured into a spray can and is directly sprayed onto the surface of the spacer 12. In the alternative, the liquid poured into the spray can may be sprayed onto a peeling paper. After the protective membrane material is solidified by evaporation of the solvent, the peeling paper on the side of the solidified material is applied onto the surface of the spacer 12, and the peeling paper is then peeled away.

Additionally, the liquid may be applied to the surface of the spacer 12 by means of a brush, instead of spraying it by means of a spray can.

Figure 7:
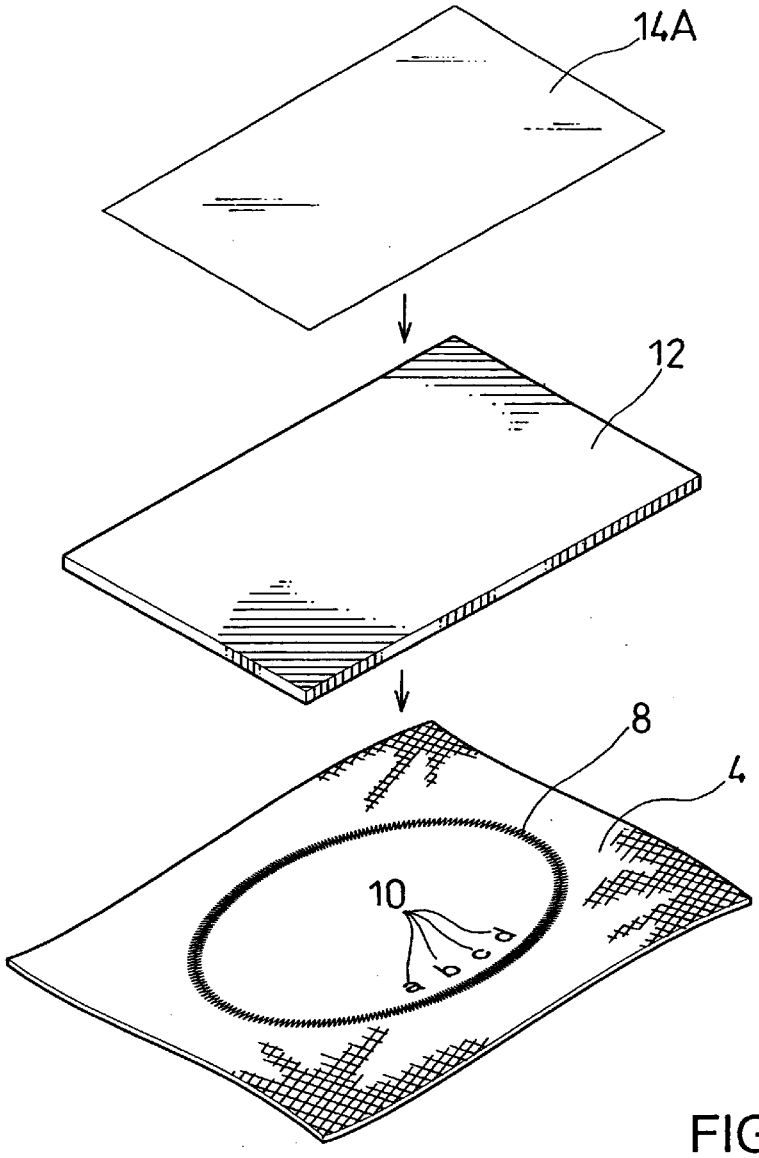
FIG. 7 is a perspective view showing a method of manufacturing a hollow three-dimensional embroidery product according to a modification of the first embodiment.
Figure 8:
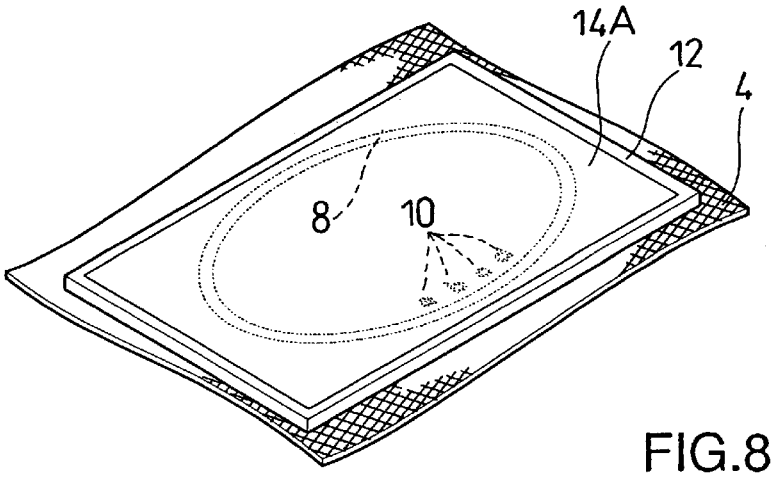
FIG. 8 is a perspective view showing the state after the step of FIG. 7 has been performed.

Although the above embodiments have been described in connection with formation of the protective membrane 14 through evaporation of the solvent from the liquid, a protective membrane 14A shown in FIGS. 7 and 8 may also be used. The protective membrane 14A is made of the same tetrachloroethylene soluble polymeric compound as the protective membrane described above, but is formed directly in a sheet-like configuration from such polymeric compound. The protective membrane 14*a* having a sheet-like configuration may be formed by an extrusion and stretching process. The protective membrane 14*a* thus formed is superimposed on the spacer 12, and the embroidering step and the dissolved and removed step with tetrachloroethylene are performed in the same manner as described in connection with FIGS. 2 to 4.

In order to prevent the protective membrane 14A from being displaced relative to the spacer 12 during the embroidering step, the protective membrane 14A may have irregularities on its lower surface (the surface facing the spacer 12) that may be formed, for example, by an embossing process. In the alternative, the protective membrane 14A may be bonded to the spacer 12 using adhesives that are soluble in tetrachloroethylene or may be bonded to the spacer 12 using a heat laminating process.

Although this embodiment has been described in connection with the embroidering operation of letter character patterns or monogram embroidery, embroidery patterns to be formed are not limited to such patterns, and any kind of patterns can be formed as three-dimensional embroideries.

Further, in order to clearly illustrate the differences between a flat embroidery and a three-dimensional embroidery, the pattern of the embroidery product of this embodiment includes a combination of flat embroideries and hollow three-dimensional embroideries. However, such a combination is not essential to the present invention.

Furthermore, the other steps of manufacturing the hollow three-dimensional product, the construction, material, configuration, the number of the other parts of the hollow three-dimensional product, and the connecting relationship therebetween are not limited to those disclosed in these embodiments.

A second embodiment of the present invention will now be described with reference to FIGS. 9 to 16. This embodiment relates to an example in which an embroidery auxiliary member, which is used as a "support member" (2) for supporting a base fabric during an embroidering operation, is used in addition to an embroidery auxiliary member, which is used as a "spacer" (1) for forming hollow three-dimensional embroideries as in the first embodiment.

Figure 9:
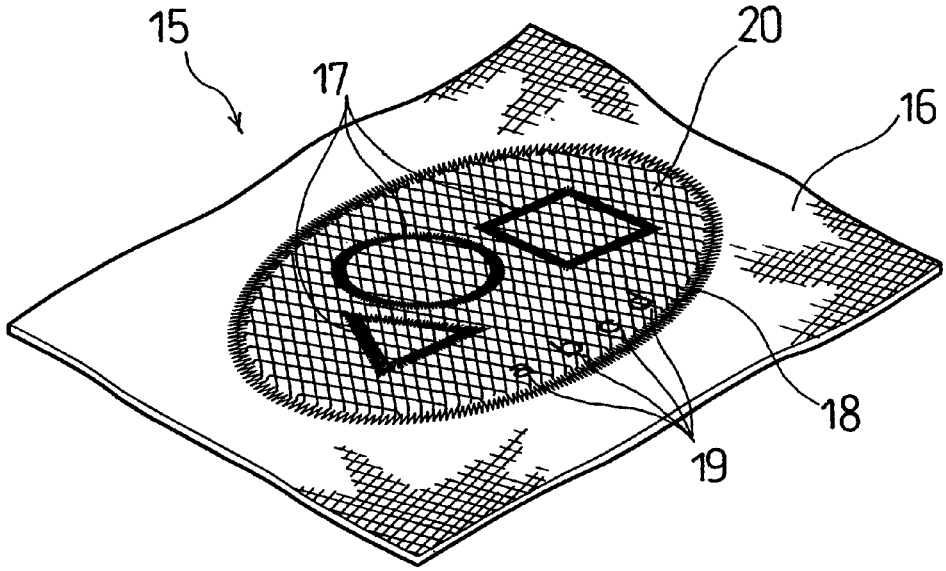
FIG. 9 is a perspective view of an embroidery product that is manufactured by using an embroidery auxiliary member according to a second embodiment of the present invention.

As shown in FIG. 9, embroidery product 15 includes hollow three-dimensional embroideries and a flat embroidery sewn on a base fabric 16. The base fabric 16 is made of material that is insoluble in tetrachloroethylene, and in particular, that is thin in thickness or is knitted, so that it is difficult to embroider the base fabric 16 with the base fabric held by an embroidery frame.

Graphic embroidery portions 17 including patterns embroidered with triangular, circular and square configurations, respectively, are positioned in the central portion of the base fabric 16. A peripheral embroidery portion 18 is embroidered to surround the graphic embroidery portions 17 in an elliptical form. Lowercase letter embroidery portions 19 are embroidered 4 along the inside edge of the peripheral embroidery portion 17 and are represented by the lowercase letters "a", "b", "c" and "d", respectively. A net-like embroidery portion 20 is embroidered to extend over substantially the entire area inside of the peripheral embroidery portion 18 and is superimposed over the graphic embroidery portions 17 and the lowercase letter embroidery portions 19.

Figure 10:
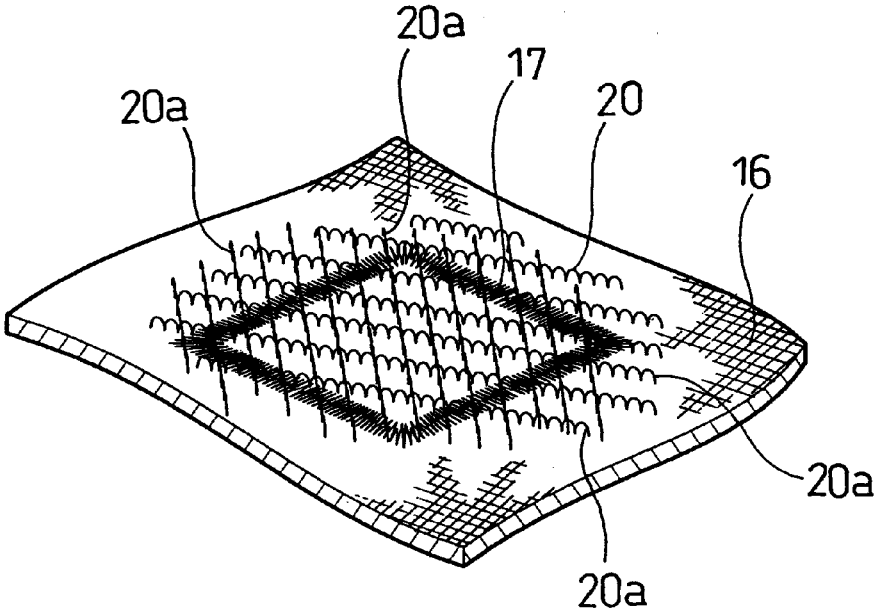
FIG. 10 is an enlarged perspective view of a part of the embroidery product shown in FIG. 9.

The graphic embroidery portions 17, the peripheral embroidery portion 18 and the lowercase letter embroidery portions 19 are flat embroideries. On the other hand, the net-like embroidery portion 20 is a hollow three-dimensional embroidery. Thus, as shown in FIG. 10, which is an enlarged view of the area including the square graphic embroidery portion 17 shown in FIG. 9, the net-like embroidery portion 20 is embroidered such that rows of stitches of embroidery yarn 20*a* intersect each other to form a grid-like pattern and such that each stitch has a three-dimensional configuration.

A process for manufacturing the three-dimensional embroidery product 15 will now be explained with reference to FIGS. 11 to 16.

Figure 11:
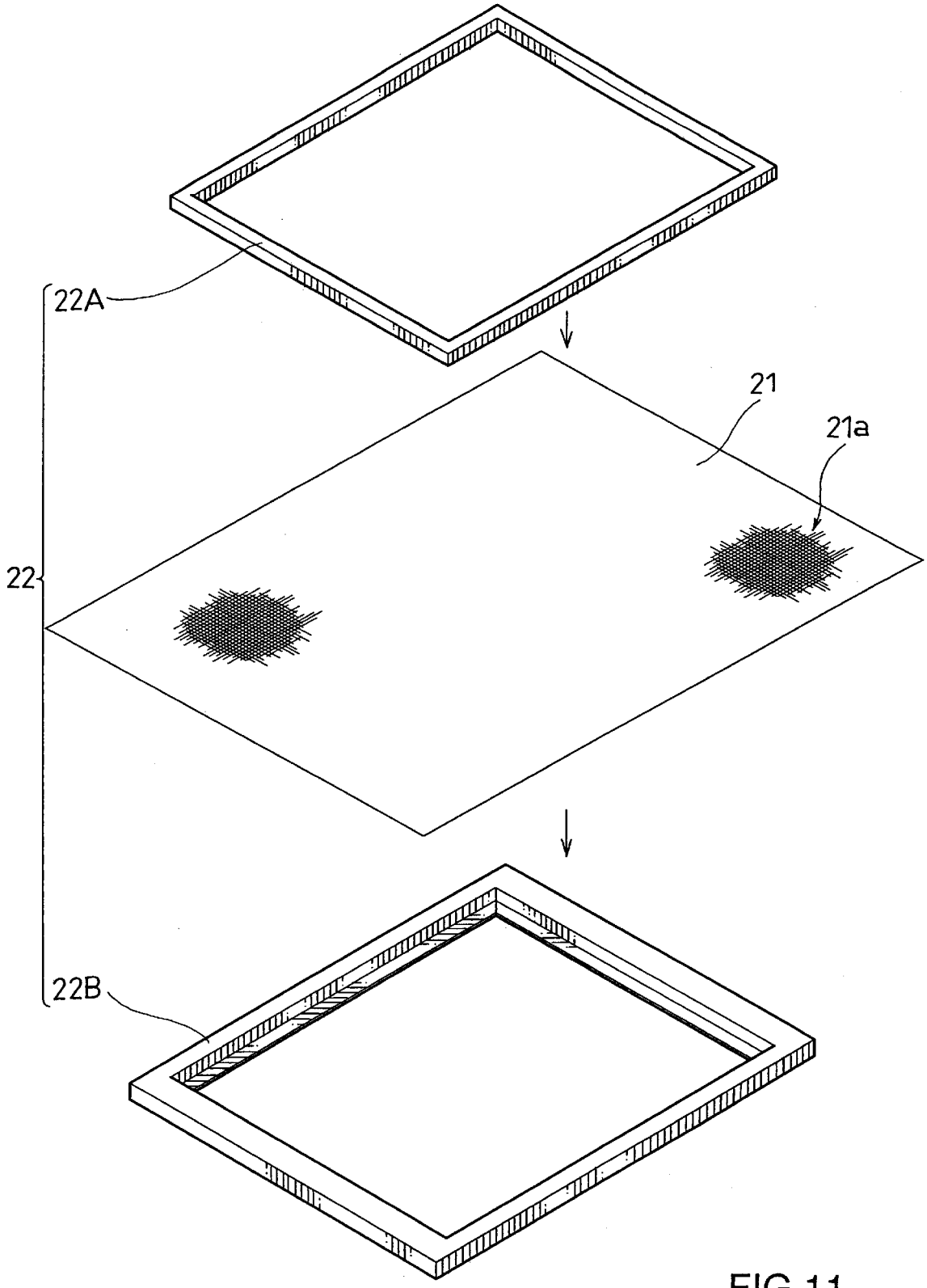
FIG. 11 is a perspective view showing one of the steps of the method of manufacturing the embroidery product shown in FIG. 9.

Similar to the spacer 12 and the protective membrane 14 (14A) of the first embodiment, a support member 21 shown in FIG. 11 is made of material that is soluble in tetrachloroethylene at ordinary temperatures. However, the support member 21 has a thickness that is smaller than the spacer 12 or the protective membrane 14 (14A). Thus, the support member 21 is not intended to form a hollow space, as is intended for the spacer 12 or the protective membrane 14, but is rather intended to support the base fabric 16 during the embroidering operation. Therefore, it is preferable that the support member 21 has a thickness as small as possible and that it still has flexibility and toughness. The material suitable for the support member 21 may include a mixed film having polystyrene and polybutadiene. Here, it is preferable that the mixing ratio of polystyrene to polybutadiene is 90:10, and in particular, the percentage of polybutadiene does not exceed 10. In addition to the mixed film having polystyrene and polybutadiene, a mixed film having polystyrene and an oxidizing agent (such as metallic oxide) may be used. In such a case, it is preferable that the mixing ratio of polystyrene and polybutadiene is 95:5, and in particular, the percentage of the oxidizing agent does not exceed 5.

Further, a surface 21*a* of the support sheet 21 is formed with fine irregularities using an embossing process.

Figure 12:
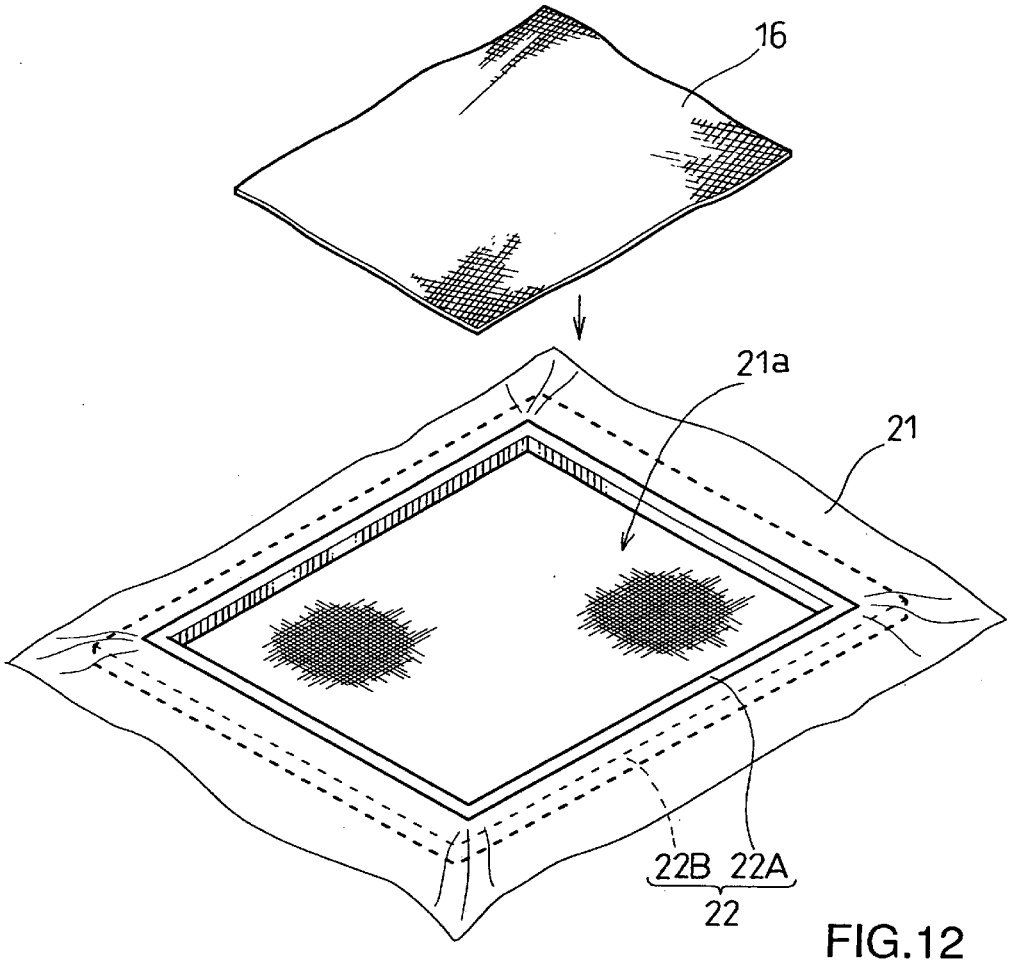
FIG. 12 is a perspective view showing the step following the step of FIG. 11.

An embroidery frame 22 has an inner frame 22A and an outer frame 22B. The embroidery frame 22 clamps and holds the support sheet 21, such that the surface 21*a* is directed upward and such that the support sheet 21 is stretched with an appropriately tension as shown in FIG. 12. The operation for holding the support sheet 21 on the embroidery frame 22 is performed by placing the support sheet 21 on the outer frame 22B with the surface 21*a* directed upward, and by subsequently fitting the inner frame 22A into the outer frame 22B with the peripheral portion of the support sheet 21 clamped between the inner frame 22B and the outer frame 22A.

Figure 13:
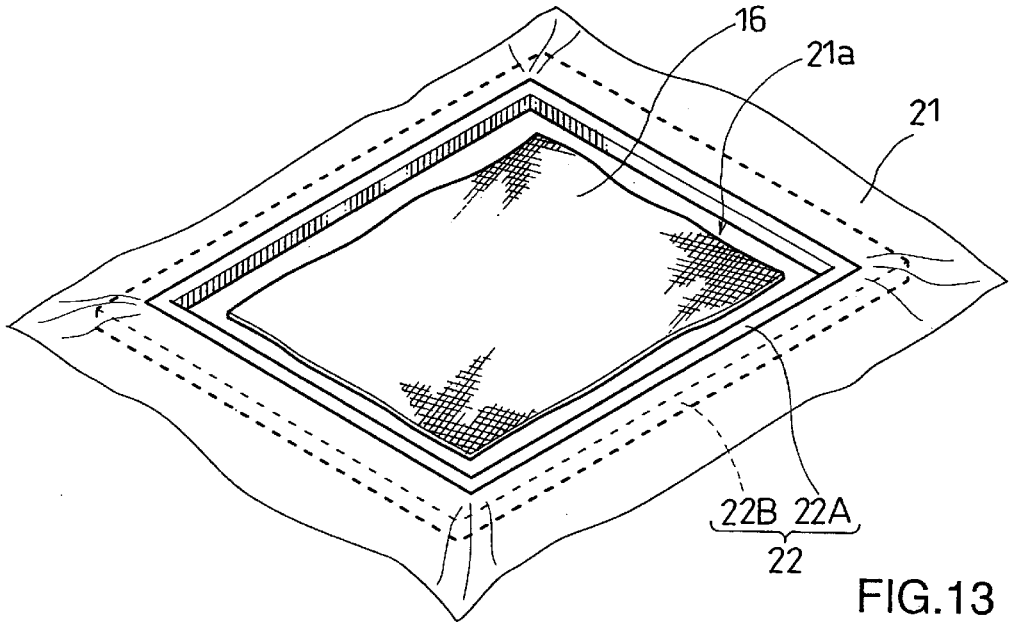
FIG. 13 is a perspective view showing the state after the step of FIG. 12 has been performed.

As shown in FIGS. 12 and 13, the base fabric 16 is then placed on the support sheet 21, which is being held by the embroidery frame 22 as previously described. Because the base fabric 16 in this embodiment is thin in thickness or is knitted, the central portion of the base fabric 16 may be loosened and curved when the base fabric 16 is being directly held by the embroidery frame 22. As a result, it may be difficult to perform the embroidering operation, or the embroidering operation may not be properly performed when the length of the stitches are enlarged. For this reason, in this preferred embodiment, the embroidering operation is performed in a manner known as a "placing-on" sewing operation, in which the base fabric is sewn while it is freely supported on the support sheet 21.

Thereafter, the graphic embroidery portions 17, the peripheral embroidery portion 18 and the lowercase letter embroidery portions 19 or the flat embroidery portions are stitched into the base fabric 16 that has been supported on the support sheet 21. This state is shown in the lower part of FIG. 14.

Figure 14:
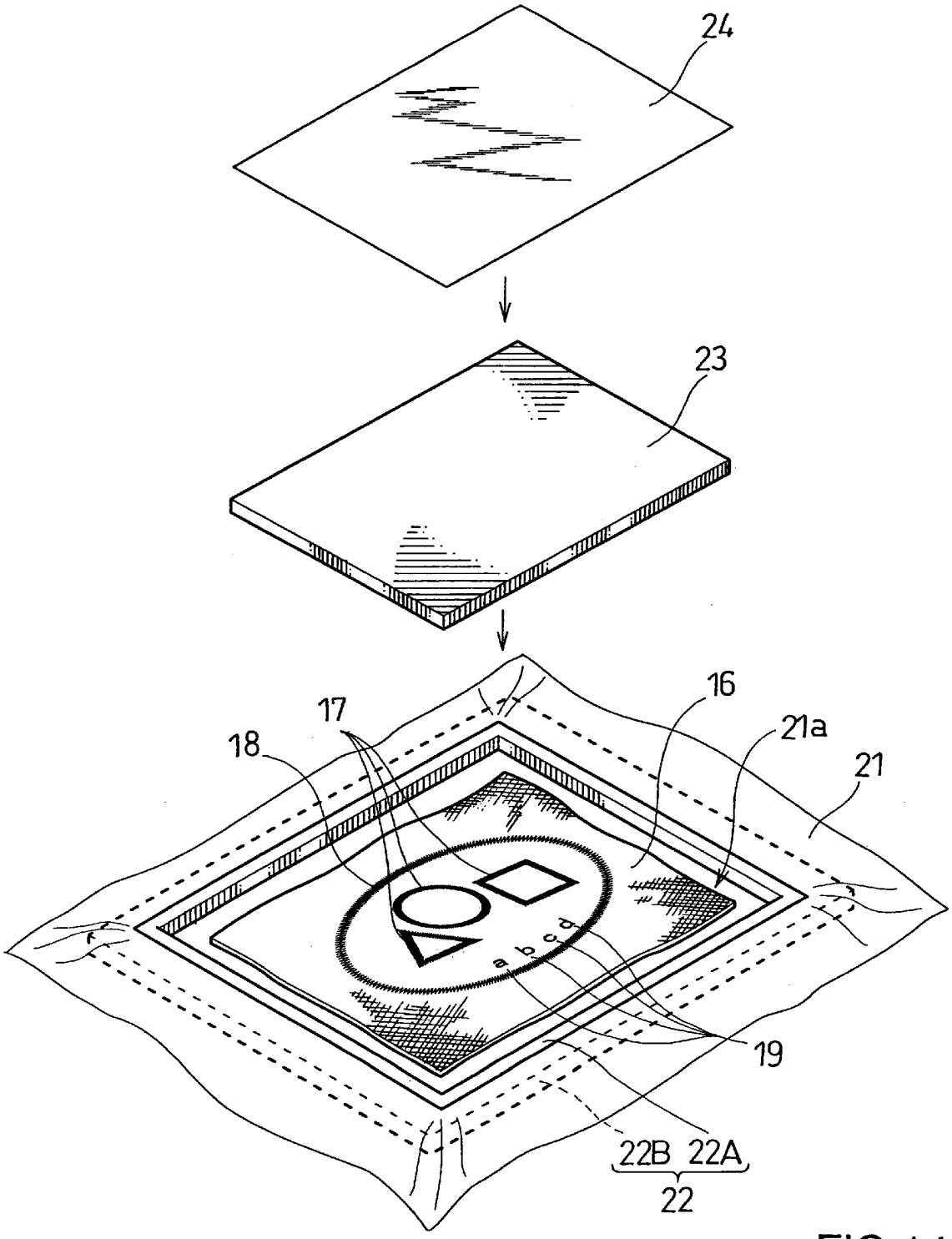
FIG. 14 is a perspective view showing the step following to the step of FIG. 13.
Figure 15:
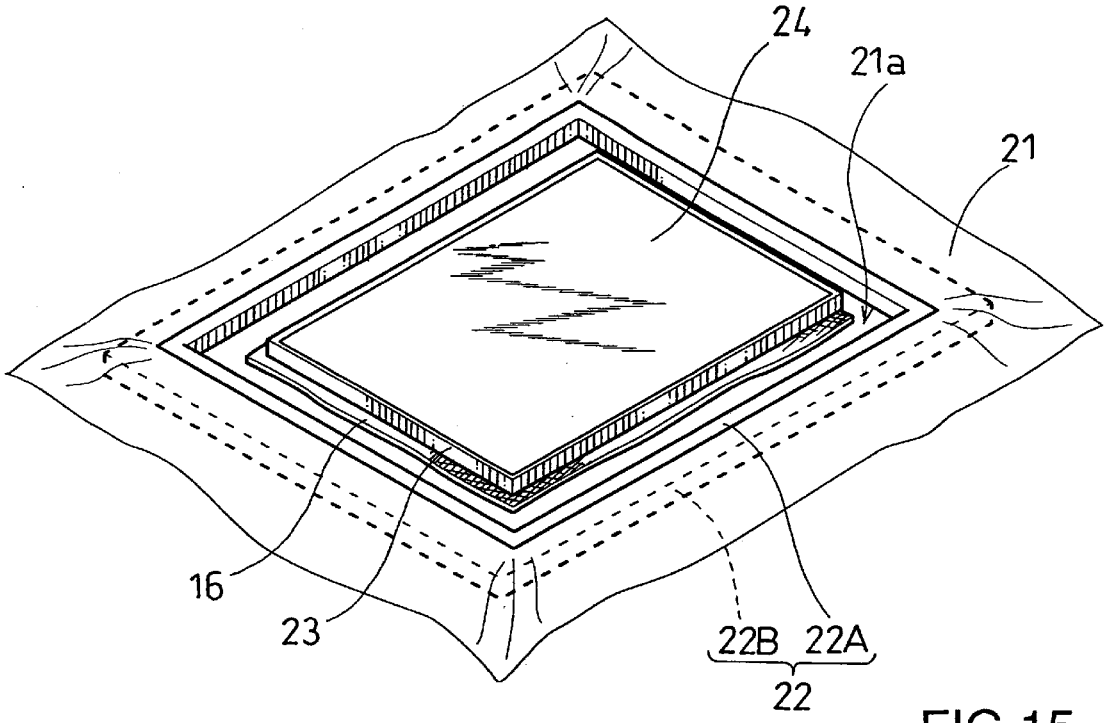
FIG. 15 is a perspective view showing the state after the step of FIG. 14 has been performed.

Subsequently, a spacer 23 and a protective membrane 24 that have substantially the same size as the base fabric 16 are superimposed on the base fabric 16 as shown in FIGS. 14 and 15. The spacer 23 and the protective membrane 24 are made of materials that are the same as the spacer 12 and the protective membrane 14 (in particular the sheet-like protective membrane 14A), respectively, so that they are soluble in tetrachloroethylene.

Figure 16:
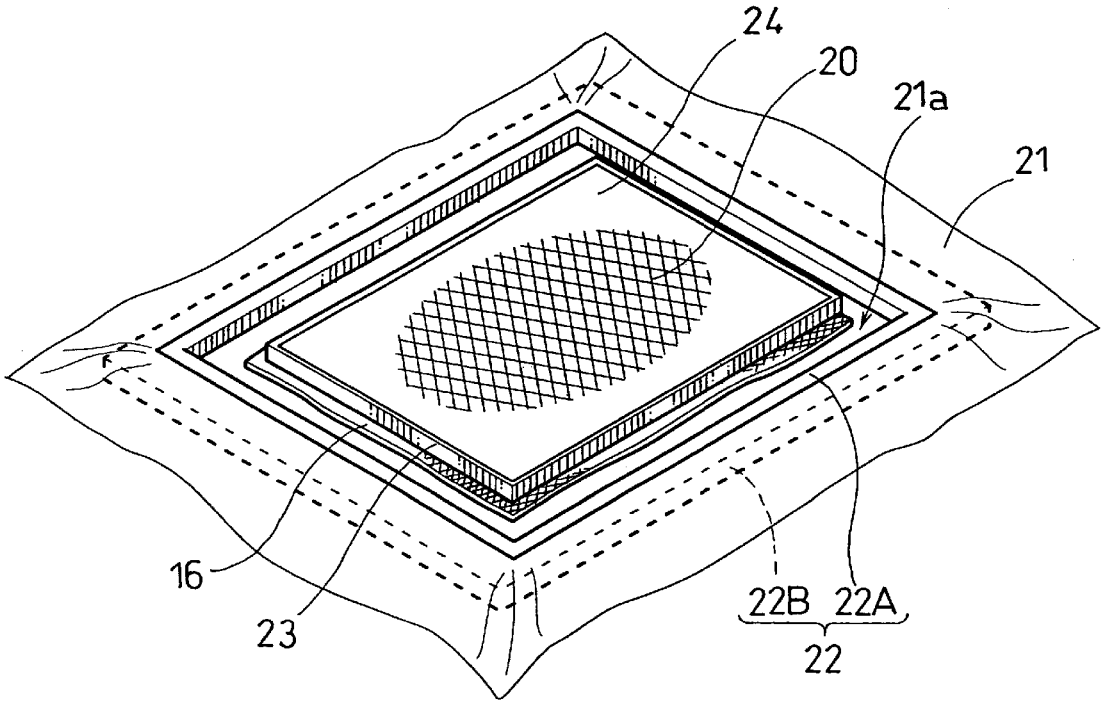
FIG. 16 is a perspective view showing the state, in which an embroidery has been performed in a net-like form after the step of FIG. 15.

Thereafter, the net-like embroidery portion 20 is stitched over and through the protective membrane 24 as well as through the spacer 23, the base fabric 16 and the support sheet 21 as shown in FIG. 16 using embroidery yarn that is insoluble in tetrachloroethylene. The net-like embroidery portion 20 is stitched over the protective membrane 24 to cover an area that substantially corresponds to the area inside of the peripheral embroidery portion 18. As a result, the state is obtained that the net-like embroidery portion 20 is formed to be spaced by the spacer 23 and the protective membrane 24 upwardly from the graphic embroidery portion 17 (or the lowercase letter embroidery portions 19) on the upper surface of the base fabric 16.

The embroidered object prepared in the manner described above is then removed from the embroidery frame 22. The embroidered object is thereafter immersed into a container filled with a tetrachloroethylene solution, and the tetrachloroethylene solution is then agitated in the same manner as described in connection with the first embodiment. The spacer 23 and the protective membrane 24 on the upper side of the base fabric 16 as well as the support sheet 21 on the lower side of the base fabric 16 are therefore dissolved and removed. As a result, the embroidery product shown in FIG. 9 can be obtained.

The characteristic features of the second embodiment are as follows:

(a) The support sheet 12 that is soluble in tetrachloroethylene at ordinary temperatures (atmospheric temperature) is used as an embroidery auxiliary member for a "placing-on" sewing operation using the base fabric 16.

(b) The net-like embroidery portion 20 is formed as a hollow three-dimensional embroidery and is superimposed on the flat embroideries or the graphic embroidery portions 17 and the lowercase letter embroidery portions 19 that have previously been stitched into the base fabric 16.

(c) The support sheet 21, the spacer 23 and the protective membrane 24 are dissolved and removed simultaneously using a single process.

In connection with characteristic feature (a), because the support sheet 21 is soluble in tetrachloroethylene, in the same manner as the spacer 23 and the protective membrane 24, the dissolving and removing operation of the support sheet 21 can be replaced by ordering a laundry to dry-clean the embroidered object.

Therefore, any embroiders or ordinary persons, who do not have installations for dissolving and removing, could practice the dissolving and removing operation.

In addition, because the upper surface 21*a* of the support sheet 21 is formed with irregularities by the embossing process, the base fabric 16 can be prevented from being displaced from the support sheet 21 during the placing-on sewing operation. Therefore, the graphic embroidery portions 17, the peripheral embroidery portion and the lowercase letter embroidery portions 19 as well as the net-like embroidery portion 20 can be reliably formed in the predetermined positions.

Further, in addition to using it for the placing-on sewing operation, the support sheet 21 can be used when an embroidery operation is performed with the support sheet 21 held by the embroidery frame 22 together with the base fabric 16, and when an embroidery product having only flat embroidery portions is to be manufactured. Thus, if the support sheet 12 is dissolved and removed after it has been removed from the embroidery frame 22 in the state shown in the lower portion of FIG. 13 or in the state prior to superimposing the spacer 23 and the protective membrane 24, an embroidery product that only has flat embroidery portions (the graphic embroidery portions 17, the peripheral embroider portion 18 and the lowercase letter embroidery portions 19 in this embodiment) can be obtained.

In connection with characteristic feature (b), because the net-like embroidery portion 20 is a three-dimensional embroidery, the graphic embroidery portions 17 and the lowercase letter embroidery portions 19 can be viewed through the mesh of the net-like embroidery portion 20, so that a unique appearance is imparted to the embroidery product.

Further, in addition to the elliptical configuration, the net-like embroidery portion 20 may have a star-like configuration or any other configurations. Moreover, the net-like embroidery portion 20 may be embroidered by using semitransparent embroidery yarn, and in other words, it may be any kind of three-dimensional embroidery, through which at least a part of the flat embroidery portions can be viewed.

With characteristic feature (c), the removing operation can be completed using a single process. Therefore, the operation for manufacturing the embroidery product can be simplified, and the time required for manufacturing the embroidery product can be shortened. Further, if both the flat embroideries (the graphic embroidery portions 17, the peripheral embroidery portion 18 and the lowercase letter embroidery portions 19) and the three-dimensional embroidery (net-like embroidery portion 20) are formed using the support sheet 21 as described in this embodiment, the dissolving step can be performed in the same manner as the first embodiment, in which both the flat embroideries or the peripheral embroidery portion 8 and the lowercase letter embroidery portions 10, and the three-dimensional embroideries or the capital letter embroidery portions 6 are formed.

This may be also applied to the case where only the flat embroideries are stitched by using the support plate 21 as previously described.

Furthermore, although the second embodiment has been described to form only the net-like embroidery portion 20 as the three-dimensional embroidery, other three-dimensional embroideries, such as the capital letter embroidery portions 6 of the first embodiment that have been embroidered in an ordinary manner, may be simultaneously formed at different positions. In addition, the flat embroidery portions on the side of the base fabric may be replaced by a predetermined pattern that has been formed using a printing process.

Additionally, although the protective membrane 24 that has been previously formed in a sheet-like form has been used as a protective membrane, any other protective membranes, which have been formed by different processes as described in the first embodiment, can be used.

Further, in addition to placing the base fabric 16 on the support sheet 21, the base fabric may be bonded to the support sheet by using adhesives that are soluble in tetrachloroethylene.

While the invention has been described with reference to preferred embodiments thereof, it is to be understood that modifications or variations may be easily made without departing from the spirit of this invention, which is defined by the appended claims.

What is claimed is:

1. An embroidery auxiliary member adapted to be superimposed on a base fabric, embroidered together with the base fabric using embroidery yarn, and thereafter removed, the embroidery auxiliary member comprising a spacer adapted to form the embroidery yarn into a hollow three-dimensional embroidery, the spacer comprising a protective member that is disposed on a surface of the spacer that is adapted to face the base fabric, wherein the embroidery auxiliary member is soluble in tetrachloroethylene at room temperature.

2. An embroidery auxiliary member of claim 1, wherein the spacer is made of expanded polystyrene.

3. An embroidery auxiliary member of claim 1, wherein the protective membrane is is soluble in tetrachloroethylene.

4. An embroidery auxiliary member of claim 3, wherein the protective membrane is resilient.

5. An embroidery auxiliary member of claim 4, wherein the protective membrane comprises a compound selected from the group consisting of polyacrylate, polymethacrylate, polyisoprene and polybutadiene.

6. An embroidery auxiliary member of claim 4, wherein the protective membrane comprises a co-polymeric compound formed by mixing at least two monomers selected from the group consisting of acrylate, methacrylate, isoprene and butadiene.

7. An embroidery auxiliary member of claim 4, wherein the protective membrane is formed by evaporating a volatile solvent from a solution that has been prepared by dissolving a tetrachloroethylene soluble material in the volatile solvent.

8. An embroidery auxiliary member of claim 7, wherein the protective membrane is formed by evaporating the volatile solvent from the solution after the solvent has been applied to the spacer.

9. An embroidery auxiliary member of claim 8, wherein the solution is sprayed onto the spacer.

10. An embroidery auxiliary member of claim 4, wherein the protective membrane is formed by attaching a tetrachloroethylene soluble sheet-like material to the spacer.

11. An embroidery auxiliary member adapted to be superimposed on a base fabric, embroidered together with the base fabric using embroidery yarn, and thereafter removed, the embroidery auxiliary member comprising a support sheet adapted to support the base fabric during an embroidering operation, wherein the support sheet comprises a mixed film including polystyrene and polybutadiene and the embroidery auxiliary member is soluble in tetrachloroethylene at room temperature.

12. An embroidery auxiliary member adapted to be superimposed on a base fabric, embroidered together with the base fabric using embroidery yarn, and thereafter removed, the embroidery auxiliary member comprising a support sheet adapted to support the base fabric during an embroidering operation and is adapted to support the base fabric in a free state on an upper surface of the support sheet and the embroidery auxiliary member is soluble in tetrachloroethylene at room temperature.

13. An embroidery auxiliary member of claim 12, wherein the support sheet comprises a mixed film comprising polystyrene and polybutadiene.

14. An embroidery auxiliary member adapted to be superimposed on a base fabric, embroidered together with the base fabric using embroidery yarn, and thereafter removed, the embroidery auxiliary member comprising a support sheet adapted to support the base fabric during an embroidering operation, wherein the support sheet has a peripheral portion that is adapted to be held by an embroidery frame and the embroidery auxiliary member is soluble in tetrachloroethylene at room temperature.

15. An embroidery auxiliary member of claim 14, wherein the support sheet comprises a mixed film including polystyrene and polybutadiene.

16. An embroidery auxiliary member adapted to be superimposed on a base fabric, embroidered together with the base fabric using embroidery yarn, and thereafter removed, the embroidery auxiliary member comprising a support sheet adapted to support the base fabric during an embroidering operation, wherein the support sheet comprises irregularities at least in an area where the base fabric is placed and the embroidery auxiliary member is soluble in tetrachloroethylene at room temperature.

17. The embroidery auxiliary member of claim 16, wherein the support sheet comprises embossed-irregularities.

18. An embroidery auxiliary member of claim 17, wherein the support sheet comprises a mixed film including polystyrene and polybutadiene.

19. A method of manufacturing a three-dimensional embroidery product using a tetrachloroethylene-soluble spacer adapted to form a hollow three-dimensional embroidery of embroidery yarn, comprising the steps of:

placing the spacer adjacent to a base fabric;

sewing the base fabric through the spacer using the embroidering yarn; and dissolving the spacer with an organic solvent comprising tetrachloroethylene, whereby the three-dimensional embroidery is formed.

20. A method as in claim 19, further comprising disposing a tetrachloroethylene-soluble protective membrane on the spacer-on a side facing the base fabric before placing the spacer on the base fabric.

21. A method as in claim 20, wherein the protective membrane is disposed on the protective member by:

dissolving a tetrachloroethylene soluble material in a volatile solvent;

disposing the dissolved tetrachloroethylene soluble material solution on the spacer; and evaporating the volatile solvent from a solution.

22. A method as in claim 19, wherein the base fabric includes a pattern formed by embroidering or printing the pattern before disposing the spacer on the base fabric and the embroidery yarn is sewn over the pattern, and wherein at least a part of the pattern is visible through the three-dimensional embroidery pattern of the three-dimensional embroidery product after dissolving the spacer.

23. A method as in claim 22, wherein the embroidery yarn is sewn in a net-like pattern.

24. A method as in claim 19, wherein the embroidery yarn comprises a semitransparent material.

25. A method of manufacturing an embroidery product using a tetrachloroethylene-soluble support sheet adapted to support a base fabric during an embroidery operation, comprising the steps of:

placing the base fabric adjacent to the support sheet;

sewing the base fabric together with the support sheet using embroidering yarn; and dissolving the support sheet with a solvent comprising tetrachloroethylene.

26. A method as in claim 25, wherein the support sheet is held using an embroidery frame disposed at a peripheral portion of the support sheet.

27. A method as in claim 25, wherein the support sheet comprises irregularities at least in an area where the base fabric is placed.

28. A method as in claim 25, further comprising placing a spacer adapted to form a hollow three-dimensional embroidery of embroidery yarn adjacent to the base fabric, wherein the spacer is sewn with the base fabric and the support sheet by the embroidery yarn and the spacer also dissolves in a solvent comprising tetrachloroethylene.

29. A method as in claim 28, wherein the support sheet is held using an embroidery frame disposed at a peripheral portion of the support sheet.

30. A method as in claim 28, wherein the support sheet comprises irregularities at least in an area where the base fabric is placed.

31. A method as in claim 28, wherein the spacer comprises a protective membrane, wherein the protective membrane is sewn with the spacer and the protective membrane is dissolved by tetrachloroethylene.

32. A method of manufacturing a three-dimensional embroidery product using a tetrachloroethylene-soluble spacer adapted to form a hollow three-dimensional embroidery of embroidery yarn, comprising the steps of:

placing the spacer adjacent to a base fabric;

sewing the base fabric through the spacer using the embroidering yarn; and completely dissolving the spacer with an organic solvent at room temperature, wherein the three-dimensional embroidery is formed.

33. A three-dimensional embroidery product, comprising a base fabric, a pattern embroidered or printed on the base fabric and a three-dimensional embroidery portion superimposed over the pattern, wherein at least a part of the pattern can be viewed through the three-dimensional embroidery portion.

34. An embroidery product as in claim 33, wherein the three-dimensional embroidery portion is sewn in a net-like form using embroidery yarn.

35. An embroidery product as in claim 34, wherein the embroidery yarn is semitransparent.

* * * * *